US005490440A

United States Patent [19]

Karlis et al.

[11] Patent Number: 5,490,440

[45] **Date of Patent: *Feb. 13, 1996**

[54] PAPER PUNCH

[75] Inventors: Robert G. Karlis, Hingham; David S. Blumenthal, Newton Center, both of Mass.

[73] Assignee: Clix Products, Inc., Natick, Mass.

[ * ] Notice: The portion of the term of this patent shall not extend beyond the expiration date of Pat. No. 5,291,813.

[21] Appl. No.: 163,833

[22] Filed: Dec. 7, 1993

Related U.S. Application Data

[63] Continuation-in-part of Ser. No. 61,427, May 6, 1993, Pat. No. 5,291,813.

[51] Int. Cl.[6] ..... B26F 1/32

[52] U.S. Cl. ..... 83/599; 16/386; 30/358; 402/1; 402/4

[58] Field of Search ..... 83/167, 599; 30/358, 30/360, 361, 363; 402/1, 4; 16/386, 254, 257

[56] References Cited

U.S. PATENT DOCUMENTS

| | | | |
|---|---|---|---|
| 829,837 | 8/1906 | Brisacher . | |
| 1,142,032 | 6/1915 | Faifer . | |
| 1,505,775 | 8/1924 | Gail | 30/358 X |
| 1,567,643 | 12/1925 | Hearne . | |
| 2,139,159 | 12/1938 | Hammen | 129/7 |
| 2,370,319 | 11/1944 | Lippincott | 164/124 |
| 2,495,687 | 1/1950 | Belmont | 206/1 |
| 2,558,567 | 6/1951 | Kaeser | 83/167 |
| 3,000,049 | 9/1961 | Terry, Jr. | 16/139 |
| 3,015,161 | 1/1962 | Semler et al. | 30/363 |
| 3,172,325 | 3/1965 | Wernham et al. | 83/599 |
| 3,372,482 | 3/1968 | Mercorelli | 30/229 |
| 3,408,889 | 10/1968 | Murphy | 83/599 |
| 3,975,105 | 8/1976 | Cline | 402/1 |
| 4,218,599 | 8/1980 | Garn | 200/159 R |
| 4,847,950 | 7/1989 | Coleman | 16/386 X |
| 4,869,143 | 9/1989 | Merrick et al. | 83/467.1 |
| 4,893,535 | 1/1990 | Bentrim et al. | 83/133 |
| 4,893,978 | 1/1990 | Frano | 411/508 |
| 4,941,381 | 7/1990 | Garner | 83/468.94 |
| 4,973,212 | 10/1990 | Jacobs | 411/508 |
| 5,291,813 | 3/1994 | Blumenthal et al. | 83/599 |

FOREIGN PATENT DOCUMENTS

| | | | |
|---|---|---|---|
| 455311 | 10/1926 | Germany | 402/1 |
| 1016630 | 1/1966 | United Kingdom . | |
| 2209133 | 4/1989 | United Kingdom . | |

*Primary Examiner*—Eugenia Jones

*Attorney, Agent, or Firm*—Morse, Altman, Dacey & Benson

[57] ABSTRACT

A paper punch for punching one or more holes into one or more sheets is disclosed. The paper punch includes a pair of top and bottom plates, formed of a polymer and hingelike mounted to one another along respective straight edges about an off-center pivot point located below the surface of the bottom plate. The off-center hingelike mounting assures an equal tolerance in entry as the punch head enters its punch hole. The hingelike mounting further includes integral mounting members designed to secure the paper punch about rings of a loose-leaf binder. The hingelike mounting includes male members formed on one of the pair of plates designed to cooperate with female members formed on the other plate. One of the pair of plates is formed with a reentrant segment to facilitate the angular separation of said pair of plates from one another preparatory to insertion of a sheet therebetween. The pivot is off-centered by a distance equal to the height of a male punching member.

12 Claims, 5 Drawing Sheets

PAPER PUNCH

This application is a continuation-in-part (C.I.P.) of U.S. application Ser. No. 08/061,427, filed May 6, 1993, titled "Paper Perforating Device" now U.S. Pat. No. 5,291,831.

BACKGROUND OF THE INVENTION

1. Field of the Invention.

The present invention relates generally to devices for perforating sheets for insertion in loose-leaf ring binders and, more particularly, to an improved paper punch adapted to be carried in a loose-leaf ring binder.

2. The Prior Art

Devices for perforating sheets for insertion in loose-leaf ring binders and adapted to be carried therein have been around for a long time. Faifer disclosed such a combined perforator and binder in 1915, see his U.S. Pat. No. 1,142,032. Improvements followed. See U.S. Pat. Nos. 1,567,643, granted to Hearne in 1925; 2,139,159, granted to Hammen in 1938; 2,370,319, granted to Lippincott in 1945; 2,495,687, granted to Belmont in 1950; and 3,172,325, granted to Wernham et al. in 1965, to name a few.

In said copending application Ser. No. 08/061,427, filed May 6, 1993, and assigned to a common assignee, Clix Products Inc., of Natick, Mass., there is disclosed a sheet perforating punch, including a pair of punch and die plates rotatably hinged to one another about a pivot point located centrally between the plates. The punch is formed of hard polymeric material. The present invention represents an improvement thereover.

As known and as exemplified by the patents referred to above, it is advantageous to have a perforating device which is designed to be carried in a loose-leaf ring binder so that papers intended to be inserted therein can be punched immediately prior to insertion.

Most, if not all, perforating devices excepting the one disclosed in said copending application, were formed of metal for accurate long lasting punching use. As stated in said copending application, "A major problem arising out of the use of comparatively inexpensive, high molecular weight polymers (hereinafter plastics) for the working parts of paper punches is that unless strict registration is maintained between the punch teeth, they wear very rapidly by engagement with the edges of the die holes or fail to effect the desired punching. The problem is exacerbated when using plastic materials that tend to be less rigid than metals and otherwise more readily deformable and less resistant to wear. Further, many paper punches formed of plastic are easily disassembled, and after several separations and reconnections, both the rotation of the hinges and the registration of holes and teeth are degraded seriously, rendering the punch relatively ineffective."

The above problems have been addressed by the invention disclosed in said copending application, with varying degrees of success. There is still room left for improvements.

SUMMARY OF THE INVENTION

It is a principal object of the present invention to overcome the above disadvantages by providing a paper punch with an off-center hingelike mounting between its plates for punching one or more holes into one or more sheets with equal tolerance upon entry of the punch head into its punch hole and immediately prior to the sheet's insertion in a loose-leaf ring binder, which paper punch is adapted to be disposed in that same loose-leaf ring binder.

More specifically, it is an object of the present invention to provide an improved paper punch formed of a polymer for perforating sheets for insertion in a loose-leaf ring binder and adapted to be carried in the same ring binder, which paper punch does not degrade over time but rather remains effective despite extensive use and even after multiple separations and reconnections at the hinges. The paper punch is designed to punch one or more holes into one or more sheets positioned therein. The sheet or sheets can vary in length from about two inches to about fourteen inches in length. The paper punch essentially includes a pair of top and bottom plates, each formed of a polymer (preferably a polycarbonate), with the plates hingelike mounted to one another along respective straight edges about an off-center pivot point located below the surface of the bottom plate. The hingelike mounting also includes mounting members integrally formed with one of the plates along its straight edge and designed to secure the paper punch to and within a loose-leaf ring binder. Cooperative recessed portions to the mounting members are formed in the straight edge of the other plate to allow for a wide degree of opening between the plates in a first operative position when a sheet or sheets are inserted therein. The pair of plates are further bounded by respective contoured edges, with the plate formed with the recessed portions also featuring a reentrant segment in the midsection of its contoured edge. This reentrant segment is designed to facilitate the angular separation of the pair of plates from a second operative position, with the plates lying in parallel spaced relation to one another, to assume the first operative position, with the plates defining an obtuse angle therebetween. The hingelike mounting of the pair of plates to each other along their respective straight edges essentially includes a plurality of male members formed on one of the plates and designed to be operatively received within cooperating female members formed on the other plate. The male and female members are formed integral with their respective plates and along their respective straight edges. One of the male members is formed with a pair of resilient bifurcated elements designed for axial deflection upon engaging its cooperative female member formed with an integral shoulder.

Other objects of the present invention will in part be obvious and will in part appear hereinafter.

The invention accordingly comprises the paper punch of the present disclosure, its component parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings wherein.

Detailed Description of the Preferred Embodiment

In general, the present invention relates to an improved paper punch formed entirely of an inexpensive polymer, such as a polycarbonate, by any one of known plastics processing techniques, such as by injection forming, which paper punch does not degrade but rather remains effective even after prolonged use. The plastic paper punch is designed for punching one or more holes into one or more sheets of paper immediately prior to the sheet's insertion in a loose-leaf ring binder. The paper punch further is designed to be carried in that same loose-leaf ring binder and ready for future use.

As mentioned, the present invention is a continuation-in-part (C.I.P.) application of U.S. application Ser. No. 08/061,427, filed May 6, 1993, now U.S. Pat. No. 5,291,813, granted Mar. 8, 1994, and assigned to a common assignee, Clix Products Inc., of Natick, Mass. The improvements incorporated in the paper punch of the invention are designed, inter alia, to facilitate its repetitive operational use in perforating sheets of paper without degradation over time. A salient feature of the paper punch of the invention resides in the off-center hingelike mounting between its pair of plates, designed to assure about an equal tolerance in entry of the punch head into its cooperating punch hole. Another set of such improvements pertains to the manual opening of the paper punch preparatory to its use. Still another set of such improvements pertains to the widening of the opening of the paper punch, to facilitate its use when inserting a sheet to be perforated. The same set of improvements also permits a visual feedback of the sheet's proper position in the paper punch immediately prior to its perforation therein for proper hole locating in the sheet. Still others of the improvements pertain to the ease of assembly of the pair of all plastic plates that comprise the paper punch of the invention. The preferred polymer of choice is polycarbonate, which is a linear polymer of carbonic acid that can be either a thermosetting or thermoplastic synthetic resin made from bisphenol and phosgene, and can, if desired, contain glass fiber reinforcement. The preferred method of forming the two plates of the paper punch of the invention is by injection molding in automatic injection molding machines, as known.

Figure 1:
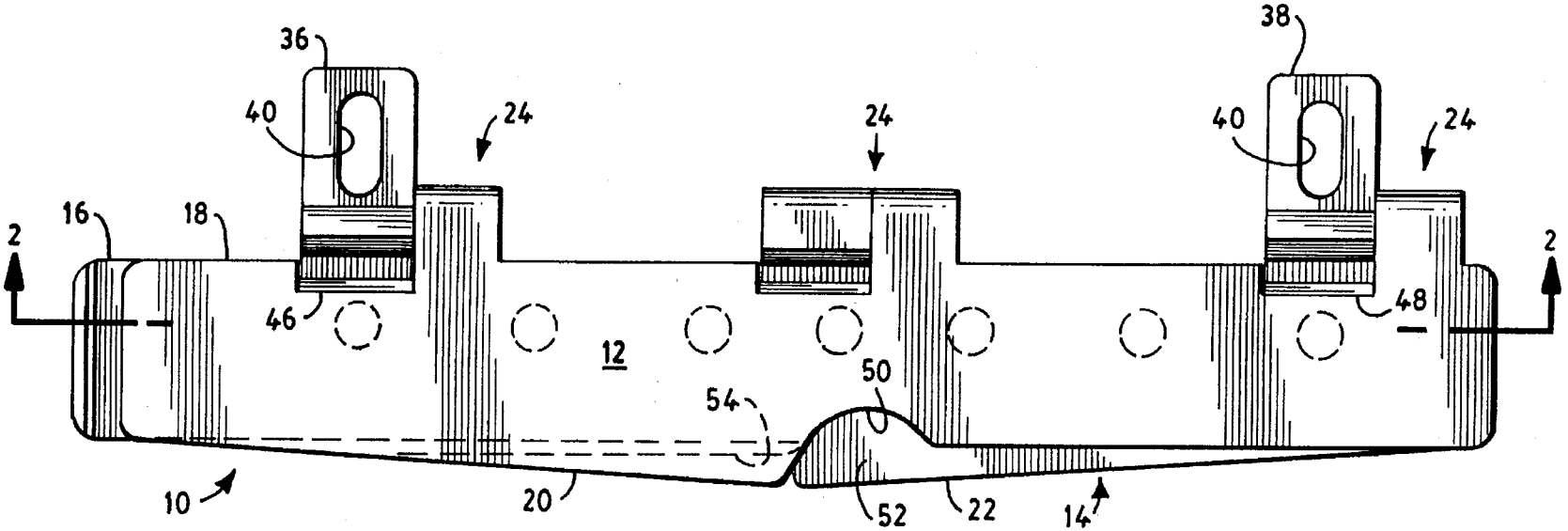
FIG. 1 is a plan view of a paper punch constructed in accordance with the present invention.
Figure 3:
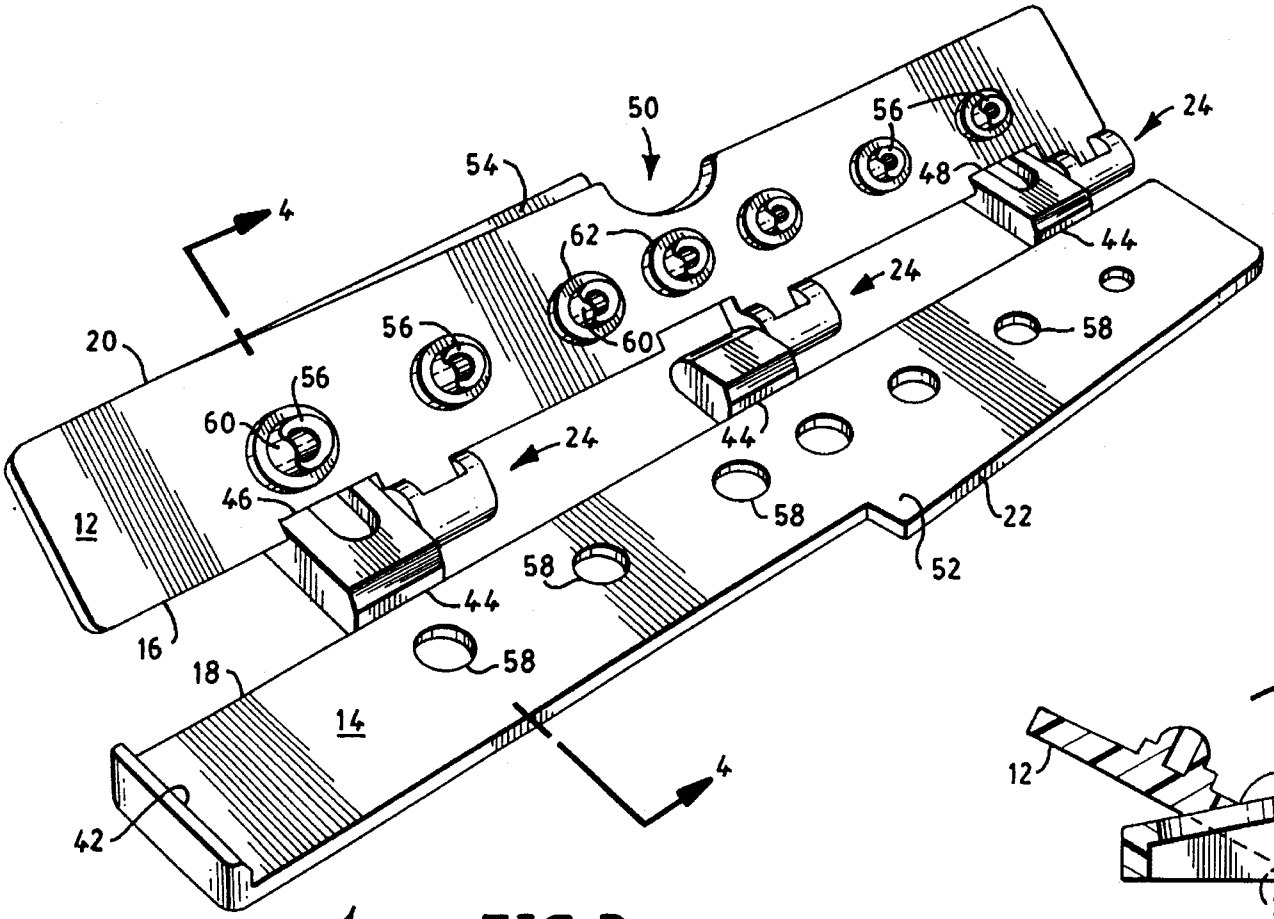
FIG. 3 is a perspective view of the paper punch of FIG. 1 in an open operative position.

An assembled paper punch 10 according to the invention is illustrated in each of its two operative positions in FIGS. 1 and 3, respectively. FIG. 1 shows the paper punch 10 in plan view in its normally closed position and, FIG. 3 shows the paper punch 10 in perspective view in its fully open position preparatory to being fitted with one or more sheets to be perforated thereby.

The paper punch 10 essentially is formed of two plates: a top punch plate 12 and a bottom die plate 14. Each of the plates 12 and 14 is bounded along its axial length by a straight edge 16 and 18 respectively, and a contoured edge 20 and 22, respectively. The thickness of the plates 12 and 14 can vary preferably from about 1/16" to about 1/8", depending on the plastic material employed in its manufacture and whether the material also includes reinforcing glass fibers or the like. The preferred width of the plates 12 and 14 between its straight and contoured edges is about an inch.

Figure 4:
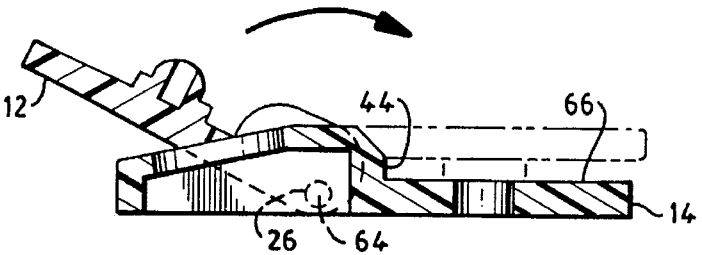
FIG. 4 is a right cross section along the line 4—4 in FIG. 3 and illustrates the off-center hingelike mounting of the plates of the paper punch according to the invention.
Figure 5:
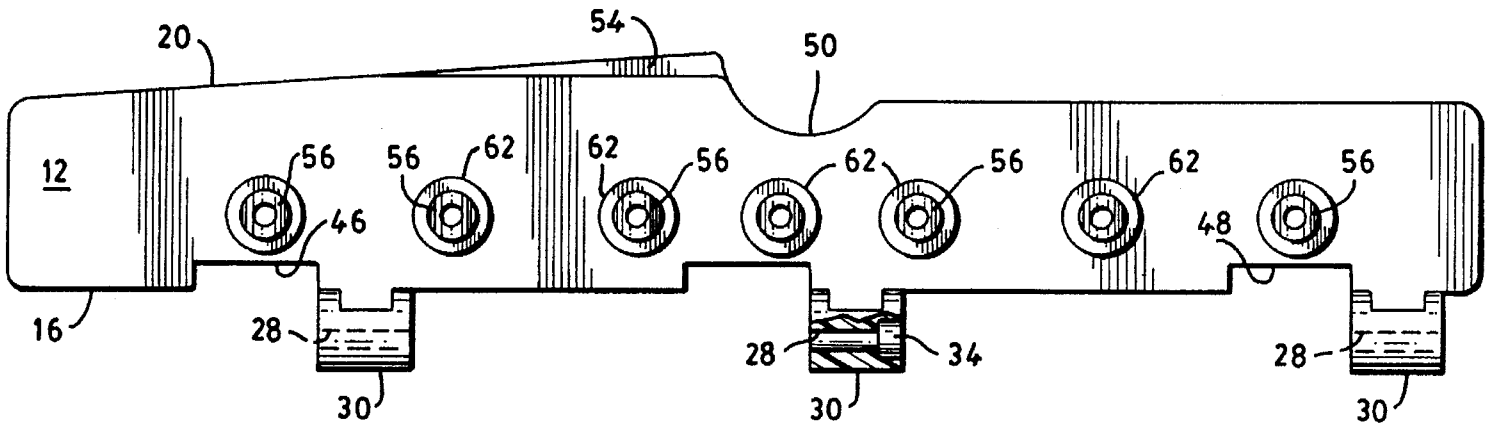
FIG. 5 is an inside plan view of one of the plates comprising the paper punch.

The plates 12 and 14 are hingelike secured to one another in an off-center mounting, as more fully described below, and along their respective straight edges 16 and 18 by hinge means 24. Hinge means 24 comprises male members 26 formed on the bottom die plate 14 in parallel spaced relation to its straight edge 18, note FIG. 6. The longitudinal axes of the male members 26 are located below the top surface 66 of the bottom die plate 14, and are designed to rotate about a pivot point 64 located below this top surface 66, as may be best observed in FIG. 4. Pivot point 64 has been shifted downward from its traditional centered pivot 68, centered between the opposed surfaces 66 and 70 of the top and bottom plates 12 and 14, respectively, please observe FIGS. 7–9. Male members 26 are designed to be received within transverse bores 28 of corresponding female members 30 formed on the top punch plate 12 also in parallel spaced relation to its straight edge 16, note FIG. 5.

Figure 6:
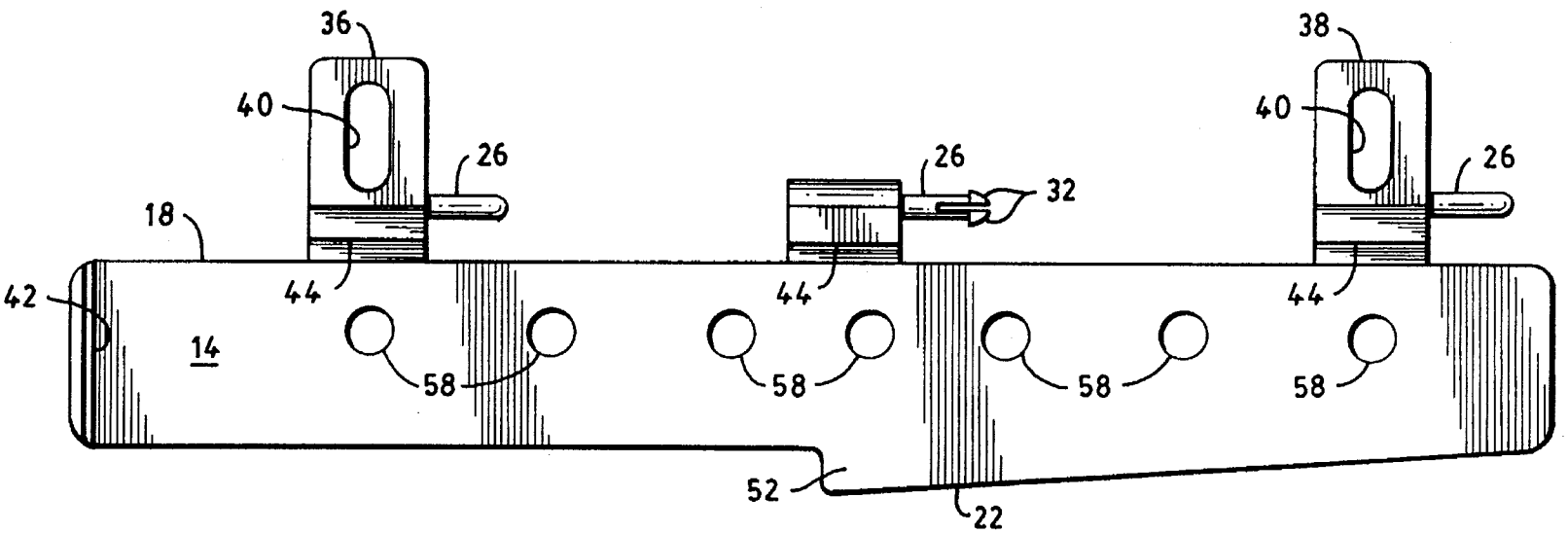
FIG. 6 is an inside plan view of the other of the plates comprising the paper punch.

One of the male members 26, preferably the one centrally located, is formed with a pair of resilient bifurcated elements 32, 32, as may be best observed in FIG. 6. The pair of resilient bifurcated elements 32, 32 are designed for axial deflection upon engaging its corresponding female member 30 whose transverse bore 28 is further provided with an enlarged segment 34, as may be best observed in FIG. 5.

A pair of mounting members 36 and 38 are integrally formed, preferably with the outermost male members 26, and define mounting apertures 40, 40. The apertures 40, 40 are designed to engage appropriately spaced rings (not shown) of a loose-leaf binder (not shown) so as to be disposed therein for use, as and when desired. A locating edge 42 is preferably provided on the bottom die plate 14 properly to locate one or more sheets (not shown) intended to be perforated in the paper punch 10. Cooperating with the locating edge 42 are a plurality of edges 44 formed integral with the male members 26 and normal to the locating edge 42.

In order to allow for a hingelike separation between the plates 12 and 14 in excess of about 120°, and also to provide a visual feedback to see sheet paper alignment, recessed portions 46 and 48 are formed in the straight edge 16 of the top punch plate 12. Recessed portions 46 and 48 are slightly wider than the mounting members 36 and 38 so as to accommodate them therebetween when the plates 12 and 14 are manipulated to assume their open operative position, as illustrated in FIG. 3.

Once one or more sheets are positioned on the bottom die plate 14 so as to abut both the locating edge 42 and each of the plurality of cooperating edges 44, the sheet or sheets are properly positioned to be perforated by the paper punch 10, assuring thereby that the resultant holes punched in the sheet or sheets will be properly spaced to be received on the rings of the loose-leaf binder. The operator can see the sheet's proper alignment through the recessed portions 46 and 48 and adjacent the locating edge 42, observe FIGS. 1 and 2.

So as to facilitate the angular separation of the plates 12 and 14 from their normally closed position, as illustrated in FIG. 1, the contoured edge 20 of the top punch plate 12 is formed with a reentrant segment 50. By placing a finger (thumb) on an underlying segment 52, now directly accessible, of the bottom die plate 14, an operator can easily manipulate the angular separation of the plates 12 and 14. Further to facilitate such angular separation, a further segment 54 of reduced transverse thickness adjacent and abutting the reentrant segment 50 also is provided in the contoured edge 20 of the top punch plate 12.

Figure 2:
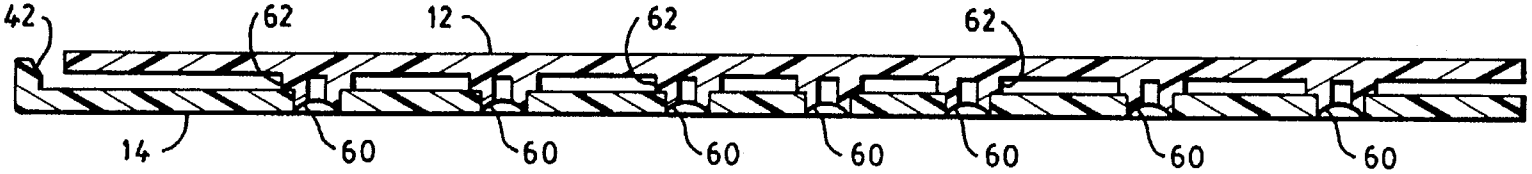
FIG. 2 is a right cross section of the paper punch of FIG. 1 along the line 2—2.

Perforations in the sheets placed within the paper punch 10 are effected by a plurality of punching members 56 formed on the top punch plate 12 cooperating with a plurality of holes 58 formed in registry with the members 56 in the bottom die plate 14. Each of the plurality of punching members 56 is formed with sharp arcuate cutting edges 60, as may be best observed in FIG. 3. These sharp arcuate cutting edges 60 are in precise conformity with the edges of the holes 58 when the plates 12 and 14 are in their closed operative position, illustrated in FIGS. 1 and 2. Each of the plurality of punching members 56 is, furthermore, provided with a shoulder 62. The thickness of these shoulders 62 determines the distance separating the plates 12 and 14 one from the other when the plates are in their normally closed operative position, as illustrated in FIGS. 1 and 2.

Figure 7:
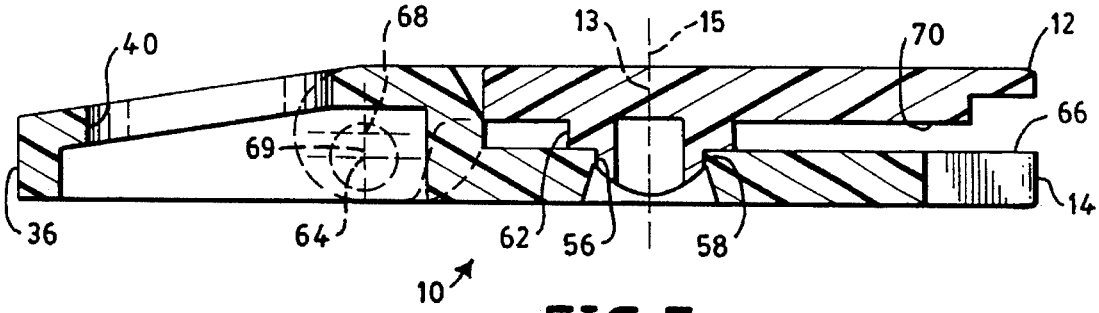
FIGS. 7–9 further illustrate the off-center hingelike mounting of the pair of plates of the paper punch as the male punch member is progressively removed from or enters into its corresponding female punch die hole.
Figure 8:
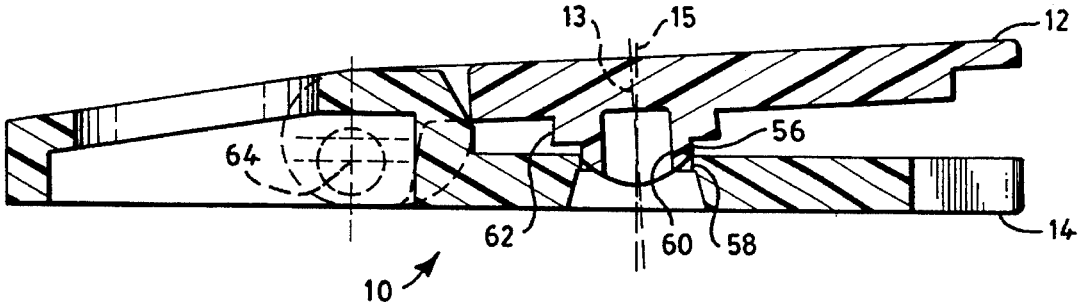
Figure 9:
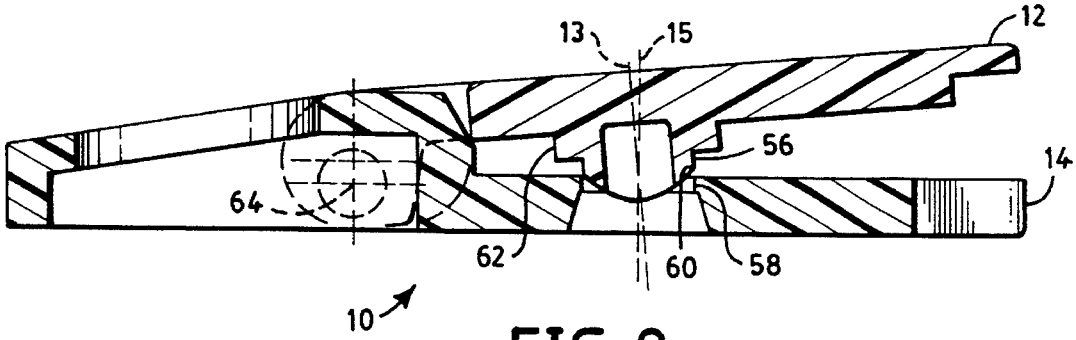

FIGS. 7–9 are elevational sections, on an enlarged scale, in a direction normal to the longitudinal axis of the paper punch 10 primarily illustrating the off-center hingelike mounting of the top and bottom plates 12 and 14 about an off-center pivot point 64 that has been downshifted from its traditional center point pivot 68.

FIG. 7 illustrates the normally closed position of the paper punch 10, with the punching member 56 snugly and fully disposed within the punching hole 58 and the shoulder 62 resting on the top surface 66 of the bottom die plate 14. As evident, the thickness of the shoulder 62 determines the distance separating the top surface 66 of the bottom plate 14 from the bottom surface 70 of the top plate 12. FIG. 8 illustrates a position in which an edge of the sharp arcuate cutting edge 60 just clears the punching hole 58, with the plates 12 and 14 separated angularly about the off-center pivot 64. FIG. 9 illustrates a position in which the plates 12 and 14 have further separated angularly so that the edge of the sharp arcuate cutting edge 60 is free and clear of the punching hole 58. Vertical pivot lines 13 and 15 for the top and bottom plates 12 and 14, respectively, coincide in the normally closed position of the punch 10, as illustrated in FIG. 7, but begin to diverge when the plates separate angularly, as illustrated in FIGS. 8 and 9.

Figure 10:
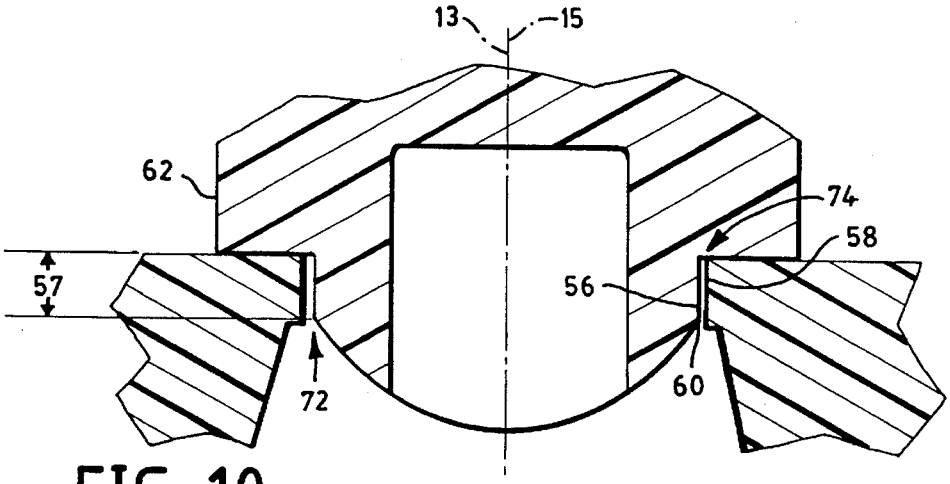
FIGS. 10–12 illustrate the tolerances upon entry of the male punch member into the female die hole.
Figure 11:
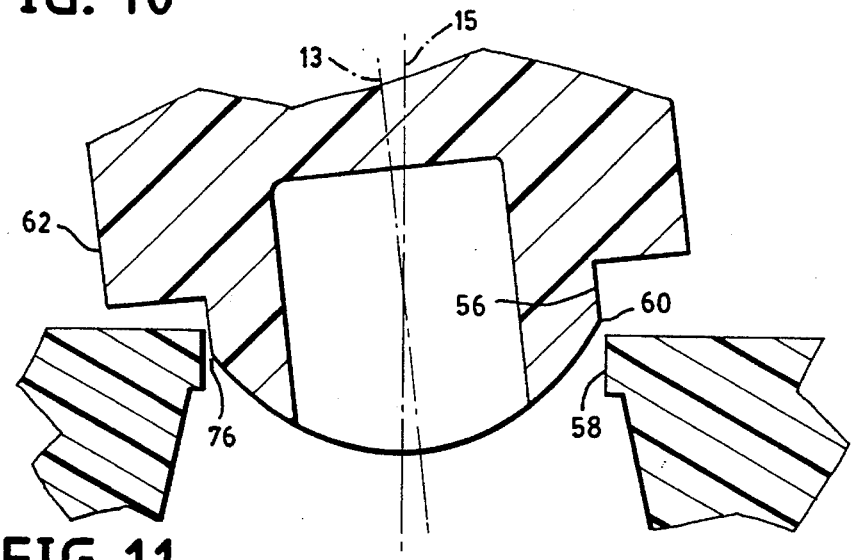
Figure 12:
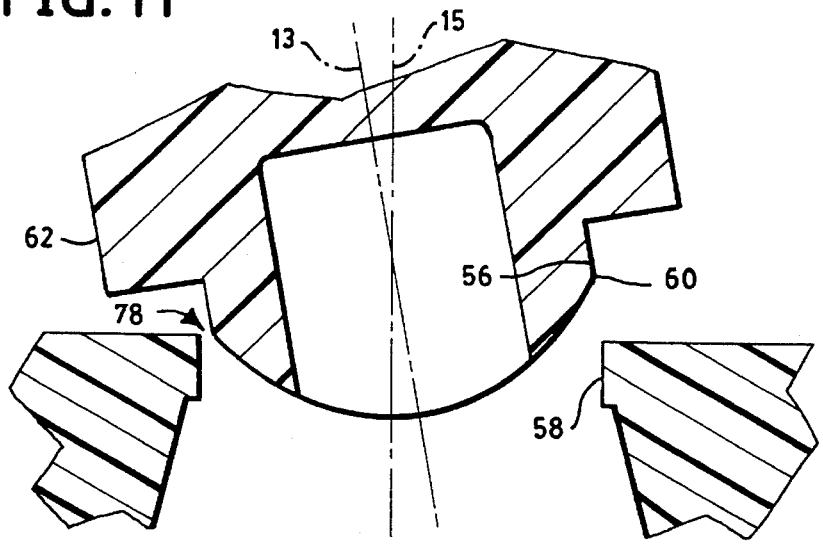

FIGS. 10–12 functionally correspond to FIGS. 7–9 and illustrate, on an enlarged scale, the equal tolerances 72, 74, 76 and 78 of the male punch member 56 upon its various entry positions into its female die hole 58. In FIG. 10, this tolerance 72 and 74 is the same all around the periphery of the male punching member 56. The height 69 by which the old pivot 68 was lowered to the new off-center pivot 64, observe FIG. 7, is the same as the height, as denoted by an arrow 57, of the male punching member 56 above its sharp arcuate cutting edges 60, observe FIG. 10. In FIG. 11, where the edge of the sharp arcuate cutting edge 60 clears the die hole 58, the tolerance 76 is still the same on the proximal side when the cutting edge 60 is still about half-way within the die hole 58. In FIG. 12, the edge of the sharp arcuate cutting edge 60 distally is now free and clear of the die hole 58, the tolerance 78 on the proximal side is however still about the same. This equal tolerance 72, which is about 0.001 inch in all position, .is the direct consequence of the downshifting of the pivot point 64, as previously explained with reference to FIGS. 7–9. As a consequence, the paper punch of the invention remains accurate over prolonged use and effective in continuing to perforate sheets of paper, with only minimal wear despite repeated use over a long and useful life.

The paper punch 10 of the invention is designed to punch at least one and not more than a dozen of holes into one or more sheets inserted thereon.

Furthermore, the paper punch 10 of the invention is designed to perforate sheets from about two inches in length and all the way to about fourteen inches in length, simply by varying its axial length. Preferably, the paper punch 10 is designed to punch two or three holes into sheets so as to accommodate the most preferred styles of loose-leaf ring binders with which it is being used.

Thus it has been shown and described a paper punch 10 for punching one or more holes into one or more sheets, which product satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in limiting sense.

What is claimed is:

1. Paper punch comprising:

(a) a pair of plates, including a top punch plate and bottom die plate, each having flat surfaces opposed to each other;

(b) each of said pair of plates bounded along its axial length by a straight edge and an opposed contoured edge; and (c) means for hingelike mounting said pair of plates to one another along their said respective straight edges and about a pivot point located off-center below said flat surface of said bottom die plate of said pair of plates;

(d) said pair of plates being formed of a substantially rigid, hard polymeric material;

(e) wherein said means is formed integral with each of said pair of plates and includes a pair of mounting members formed on one of said pair of plates, with the other of said pair of plates formed with recessed portions in its said straight edge, said recessed portions cooperating with said pair of mounting members to allow a hingelike separation between said pair of plates in excess of 120°, said contoured edge of one of said pair of plates formed with a reentrant segment at its mid-section; and wherein said means for hingelike mounting of said pair of plates allows assembly and disassembly thereof and comprises male members formed on one of said pair of plates designed to be operatively received in female members formed on the other of said pair of plates, one of said male members formed with a pair of resilient bifurcated elements designed for axial deflection upon engaging its said female member.

2. The paper punch of claim 1 wherein said pair of plates are respectively provided with operationally cooperating opposed structure designed for punching holes in a sheet positioned between said pair of plates when said plates are in a first open position, and punching said holes when said plates are moved into a second closed position, wherein an equal tolerance exists peripherally between said operationally cooperating opposed structure when said plates are in said second closed position; and wherein said operationally cooperating opposed structure includes male and female punching members, wherein said off-center pivot point is off-center by a distance equal to the height of said male punching members.

3. The paper punch of claim 1 wherein said contoured edge of said one of said pair of plates is further provided with a segment of reduced transverse thickness adjacent and abutting said reentrant segment.

4. The paper punch of claim 1 wherein each of said pair of mounting members is formed with a slot to fit about a ring of a loose-leaf binder.

5. The paper punch of claim 1 designed to punch at least one hole into a sheet positioned therein, wherein said sheet is at least two inches in length but not more than fourteen inches in length.

6. Paper punch comprising:

(a) a top punch plate and a bottom die plate, each formed of a substantially rigid, hard polymeric material;

(b) each of said plates having opposed flat surfaces and bounded along its axial length by a straight edge and a contoured edge;

(c) hinge means for removably securing said plates to one another along their said respective straight edges about a pivot point located below said flat surface of said bottom die plate and in two positions: a first position with said plates being in parallel spaced relation to one another, and a second position with said plates being in open relation to one another, defining an obtuse angle between said plates;

(d) said hinge means comprising male members formed on said bottom die plate and corresponding female members formed on said top punch plate, one of said male members formed with a pair of resilient bifurcated elements designed for axial deflection upon engaging its said corresponding female member.

7. The paper punch of claim 6 further including a pair of mounting members integrally formed with two of said male members and defining apertures designed to engage rings of a loose-leaf binder; a pair of recesses formed along said straight edge of said top punch plate in operative association with said pair of mounting members formed on said bottom die plate to allow for said plates to assume said obtuse angle therebetween; and a reentrant segment formed in said contoured edge of said top punch plate at its mid-section.

8. The paper punch of claim 6 wherein said polymeric material is a polycarbonate.

9. The paper punch of claim 6 wherein said contoured edge of said top punch plate is further provided with a segment of reduced transverse thickness adjacent said reentrant segment.

10. The paper punch of claim 6 designed to punch at least one but not more than twelve holes into a sheet positioned between said pair of plates.

11. The paper punch of claim 6 designed to punch at least one hole into a sheet positioned therein, wherein said sheet is at least two inches in length but not more than fourteen inches in length.

12. The paper punch of claim 6 wherein said bottom die plate is provided with a raised locating edge normal to its said straight edge.

* * * * *